US008033070B2

(12) United States Patent
Morello et al.

(10) Patent No.: US 8,033,070 B2
(45) Date of Patent: Oct. 11, 2011

(54) BUILDING PANEL AND PANEL CRIMPING MACHINE

(75) Inventors: Frederick Morello, Johnstown, PA (US); Matthew J. Yagodich, Johnstown, PA (US)

(73) Assignee: M.I.C. Industries, Inc., Reston, VA (US)

( * ) Notice: Subject to any disclaimer, the term of this patent is extended or adjusted under 35 U.S.C. 154(b) by 392 days.

(21) Appl. No.: 09/896,365

(22) Filed: Jun. 29, 2001

(65) Prior Publication Data

US 2003/0000156 A1 Jan. 2, 2003

(51) Int. Cl.
*E04C 2/32* (2006.01)
*E04D 3/30* (2006.01)
*E04D 1/00* (2006.01)

(52) U.S. Cl. ..... 52/462; 52/74; 52/86; 52/519; 52/520; 52/588.1; 52/542

(58) Field of Classification Search ..... 52/86–88, 52/80.1, 81.1, 528–531, 536–539, 558–559, 52/673–674, 473, 462, 450, 465, 447, 334–336, 52/74–76, 518–520, 478, 588, 460, 469, 52/470, 397

See application file for complete search history.

(56) References Cited

U.S. PATENT DOCUMENTS

| | | | | | |
|---|---|---|---|---|---|
| 3,009,509 | A | * | 11/1961 | Martin | 72/181 |
| 3,173,225 | A | * | 3/1965 | Goodwill et al. | 52/245 |
| 3,276,171 | A | * | 10/1966 | Brown | |
| 3,660,482 | A | * | 5/1972 | Elizalde | 52/537 |
| 3,842,647 | A | | 10/1974 | Knudson | |
| 3,902,288 | A | * | 9/1975 | Knudson | 52/630 |
| 4,301,628 | A | * | 11/1981 | Lowe | 52/91.3 |
| 4,358,916 | A | * | 11/1982 | Lacasse | 52/630 |
| 4,364,253 | A | | 12/1982 | Knudson | |
| 4,390,010 | A | * | 6/1983 | Skillman | 126/621 |
| 4,472,473 | A | * | 9/1984 | Davis et al. | 428/184 |
| 4,505,084 | A | * | 3/1985 | Knudson | 52/528 |
| 4,505,143 | A | | 3/1985 | Knudson | |
| 4,579,785 | A | * | 4/1986 | Karoubas | 428/599 |
| 4,759,159 | A | | 7/1988 | Blazley | |
| 4,796,393 | A | * | 1/1989 | Toti | 52/76 |
| 4,819,398 | A | * | 4/1989 | Dameron | 52/529 |
| 4,962,622 | A | * | 10/1990 | Albrecht et al. | 52/630 |
| 5,020,295 | A | * | 6/1991 | Haines et al. | 52/630 |

(Continued)

FOREIGN PATENT DOCUMENTS

CN 2152845 1/1994

(Continued)

OTHER PUBLICATIONS

European Search Report for EP 02 74 6567.

(Continued)

*Primary Examiner* — Jeanette E. Chapman
(74) *Attorney, Agent, or Firm* — Jones Day

(57) ABSTRACT

The present invention is an improved building panel having increased strength and rigidity, thereby reducing present design constraints imposed upon buildings constructed of interconnected panels. The building panel includes a novel curved central portion connected to two diverging inclined side wall portions in lieu of a straight central portion. Replacing the straight curved portion with a curved portion provides the building panel with increased strength and rigidity, thereby allowing the building panel to withstand increased positive and negative bending moments. Thus, a building constructed of panels having such curved central portions will reduce the present design constraints and increase the size and shape of buildings constructed of such panels.

22 Claims, 12 Drawing Sheets

U.S. PATENT DOCUMENTS

| | | | | |
|---|---|---|---|---|
| 5,249,445 | A | 10/1993 | Morello | |
| 5,359,871 | A | 11/1994 | Morello | |
| 5,375,943 | A * | 12/1994 | McCavour et al. | 405/126 |
| 5,393,173 | A | 2/1995 | Morello | |
| 5,584,198 | A | 12/1996 | Morello | |
| 5,651,226 | A * | 7/1997 | Archibald | 52/518 |
| 5,655,338 | A * | 8/1997 | Lucas | 52/169.6 |
| 6,260,323 | B1 * | 7/2001 | Hockey | 52/481.1 |
| 6,282,936 | B1 * | 9/2001 | Blazley | 72/176 |
| 6,419,302 | B2 * | 7/2002 | Mikuni | 296/187 |
| 6,543,197 | B2 * | 4/2003 | Wetzel, III et al. | 52/581 |
| 6,722,087 | B1 * | 4/2004 | Morello | 52/86 |

FOREIGN PATENT DOCUMENTS

| | | | |
|---|---|---|---|
| DE | 16 84 709 | A1 | 6/1971 |
| GB | 770062 | A | 3/1957 |
| GE | 1695 | | 5/1999 |
| HU | 181342 | B | 3/1985 |
| HU | 189778 | B | 7/1988 |
| HU | 190331 | B | 7/1988 |
| HU | 203688 | B | 9/1991 |
| JP | 63-280148 | | 11/1988 |
| JP | 06-280352 | | 10/1994 |
| NZ | 338021 | B2 | 10/1998 |
| NZ | 531441 | | 6/2004 |
| WO | WO 98/45064 | | 10/1998 |
| WO | WO 03/018927 | | 3/2003 |

OTHER PUBLICATIONS

Search Report for Corresponding Georgian Application No. AP 2002 005403, dated Aug. 11, 2004.

Search Report for Corresponding Hungarian Application No. PO 400870, dated May 17, 2004.

Search Report for Corresponding New Zealand Application No. 530016, dated Aug. 9, 2004.

Examination report from the Korean Intellectual Property Office dated Aug. 26, 2008 for related Korean Application No. 10-2003-7016950 and English translation.

* cited by examiner

BUILDING PANEL AND PANEL CRIMPING MACHINE

TECHNICAL FIELD

This invention relates to a building panel and a building structure comprising a plurality of interconnected building panels. This invention also relates to a panel forming apparatus and more particularly, to a crimping machine within the panel forming apparatus.

BACKGROUND

Most buildings are constructed of a combination of columns (i.e., posts) and beams, which are covered by plywood or some sort of metal or plastic sheeting. In an effort to reduce the overall construction time, however, contractors often construct buildings, and particularly, the exterior walls of buildings, with prefabricated building panels. Constructing a building with such panels increases productivity because entire walls are manufactured directly at the construction site so that they can be swiftly combined and erected.

These prefabricated panels are typically manufactured from steel sheet metal, and configured to conform to the desired shape of the building. For example, an arch style building 100, such as the one illustrated in FIG. 1, is comprised of a plurality of interconnected arch shaped panels. The panels are interconnected by placing them adjacent one another and forming a sealed joint where the edges of the panels overlap. Thus, the length of the building is not only dependent upon the width of each panel, but it is also a function of the overall number of interconnected panels.

In addition to constructing arch shaped buildings, panels may be used to construct gable style buildings 200 and double radius style buildings 300, such as those illustrated in FIGS. 2 and 3, respectively. Although not shown, interconnected panels can also be used to construct straight sided buildings or portions thereof. Regardless of whether the building has a curved or straight profile, the cross section of the panels used to construct such buildings are sometimes similar.

For example, FIG. 4 illustrates a cross section of a known building panel typically used to construct such buildings. The building panel 400 includes a central portion 402 and two inclined side wall portions 410, 412 extending from opposite ends of the central portion 402. The central portion 402 is straight, and in order to increase that portion's stiffness it may include a notched portion 408. Assuming the central portion includes a notched stiffener, the central portion 402 would be separated into two sub-central portions 404, 406. Although such a feature is not shown, the inclined side wall portions 410, 412 may also include notches to stiffen those portions of the building panel.

Continuing to refer to FIG. 4, the building panel 400 further includes two wing portions 414, 416 extending from the inclined side wall portions 410, 412, respectively. The wing portions 414, 416 are substantially parallel to the straight central portion 402 and may include notch stiffeners 422, 424. A hem portion 420 extends from one wing portion 416, and a complementary hook portion 418 extends from the other wing portion 414.

Referring to FIG. 5, there is shown a building structure 500 comprising two building panels 400 interconnected by the complementary hem 420 and hook portions 418. Referring to FIG. 5A, which is an enlarged view of the connection, the hem portion 420 comprises an inclined hem section 430 and an end section 432. The hook portion 418 comprises a complementary inclined section 434, an intermediate section 436 parallel to the wing portions, and an end section 438. As discussed in U.S. Pat. No. 5,393,173, which is hereby incorporated by reference, the end section 432 of the hem portion 420 snaps into place adjacent the intermediate section 436 of the hook portion 418. After the hem portion 420 snaps in place, a seaming device bends the end section 438 of the hook portion 418 up and in toward the end section 432 of the hem portion 420. Bending the end section 438, therefore, seams the two panels 400 together to form a single building structure 500.

As mentioned above, the length of the building increases with the number of interconnected panels. The length of the building is also dependent upon the width of each panel. The width of the building, on the other hand, is a function of the length of each panel. Thus, the overall size of the building is dependent upon the dimensions of each panel and the total number thereof.

As the size of each panel increases, so does its weight. Because weight is a gravitational force, which imparts a moment upon structures, as the width and length of each panel increases, the panel is subject to greater moments. Although it has been exaggerated for the purposes of explanation herein, FIG. 6 illustrates an arch shaped panel 600 subject to both positive and negative bending moments resulting from the weight of the panel. Particularly, the weight of building panel 100 illustrated in FIG. 1, imparts negative bending moments at locations 602 and 604 and positive bending moments at the location identified as 606. Although the central portion of the panel includes a notch stiffener, the typical design of such panels often results in subjecting the panel to a greater negative bending moment, thereby increasing the tendency of distorting the panel's original configuration, as exaggerated in FIG. 6.

Similarly, the gable style building 200 and double radius style building 300, illustrated in FIGS. 2 and 3, respectively, are also subject to undesirable bending moments. As illustrated in FIG. 7, the gable style building 200 is subject to negative bending moments in the regions identified as 702 and 704, which overcome the positive bending moment of region 706, thereby creating an overly emphasized distorted building panel 700. Furthermore, as illustrated in FIG. 8, the double radius style building 300 is subject to negative bending moments in the regions identified as 802 and 804, which overcome the positive bending moment of region 806, thereby creating an overly embellished disfigured building panel 800.

As the size of the building structure increases, so does its weight. Therefore, as the size of the building structure increases, the building panels are subject to increased bending moments, the direction of which are dependent upon the orientation of the building structure. The inability of the building panels to withstand such bending moments, in turn, imparts design constraints on the building, thereby limiting its overall size and shape. Accordingly, there is a need to improve the panel's ability to withstand greater bending moments.

OBJECTS OF THE INVENTION

It is an object of the invention to increase the building panel's ability to withstand increased bending moments.

It is another object of the invention to minimize the design constraints of buildings constructed of panels.

It is another object of the invention to increase the size of buildings constructed of panels.

It is a further object of the invention to increase the variety of shapes of buildings constructed of panels.

It is a further object of the invention to increase the building panel's strength and rigidity.

It is even a further object of the invention to develop a machine capable of manufacturing such an improved building panel.

SUMMARY OF THE INVENTION

The present invention is an improved building panel capable of withstanding increased bending moments. The building panel includes a curved central portion in lieu of a straight central portion. The curved central portion has a concave shape, which provides the building panel with superior rigidity in comparison to the straight central portion. The panel's improved strength and rigidity even surpass that of a building panel having a straight central portion that includes a notched stiffener. Because the curved central portion provides the building panel with increased strength and rigidity, the building panel is able to withstand increased positive and negative bending moments. Thus, a building constructed of panels having such a curved central portions reduces some of the present design constraints, thereby allowing contractors to increase the size and shape of buildings constructed of such panels.

Accordingly the present invention relates to a building panel, comprising a curved central portion, a pair of side wall portions extending from opposite ends of the curved central portion, and a pair of complementary wing portions extending from said side wall portions.

The panels of the present invention can be used to construct a building by seaming together multiple panels. Thus, the present invention also relates to a building structure comprising a plurality of interconnected panels, each of the panels comprising a curved central portion, a pair of side wall portions extending from opposite ends of the curved central portion, and a pair of wing portions extending from the side wall portions, wherein one wing portion extends from one of the side wall portions and the other wing portion extends from the second side wall portion, wherein the complementary wing portions connect to one another when opposite sides of the panels are placed adjacent to each other.

If it is desirable to corrugate the improved building panel, it is preferable that the crimping machine be designed to accept (or form) a panel having a radially curved central portion. Thus, the present invention also relates to a panel crimping machine that corrugates the improved building panel of the present invention. The panel crimping machine includes a set of male and female crimping rollers, wherein each crimping roller includes a plurality of crimping blades extending radially from their respective hubs. Additionally, the profiles of the male and female crimping blades include a complementary curved shape. Specifically, the profile of the male crimping blade has a convex shape and the profile of the female crimping blades has a complementary concave shape, wherein the combination of the convex and concave shape corresponds to the shape of the building panel of the present invention. Thus, as the central portion of the panel pass between the driven crimping rollers, the crimping rollers rotate and the blades intersect and corrugate that central curved portion.

Accordingly, the panel crimping machine includes a pair of crimping rollers offset from one another and located within the panel crimping machine such that when a panel enters the panel crimping machine the curved central portion of the panel passes between the crimping rollers, the pair of crimping rollers comprising a male crimping roller comprising a hub and a plurality of male crimping blades extending radially from the hub, each of the male crimping blades having a convex profile, and a female crimping roller comprising a hub and a plurality of female crimping blades extending radially from the hub, each of the female crimping blades having a concave profile complimentary to the convex profile of the male crimping blades and means for driving the pair of crimping rollers such that the crimping rollers rotate, thereby causing the male crimping blades and the female crimping blades to alternately intersect and crimp the curved central portion of the panel.

The foregoing features and advantages of the present invention will become more apparent in light of the following detailed description of exemplary embodiments thereof as illustrated in the accompanying drawings.

BRIEF DESCRIPTION OF THE DRAWINGS

FIG. 5A is an enlarged view of the connection of the building panels illustrated in FIG. 5.

DETAILED DESCRIPTION OF PREFERRED EMBODIMENTS

Figure 9:
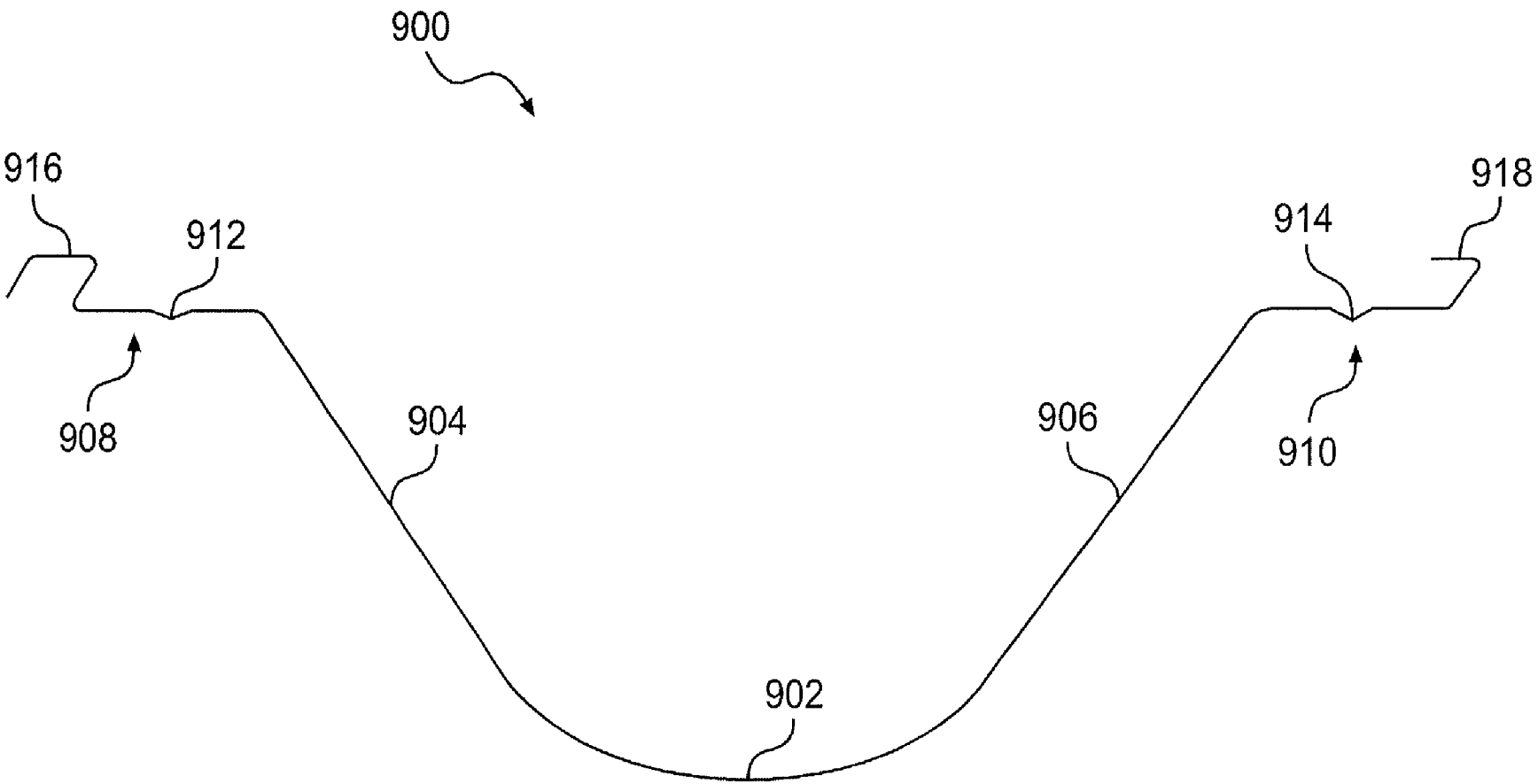
FIG. 9 is a cross sectional view of one embodiment of a building panel comprising the present invention.

Referring to FIG. 9, there is shown a building panel 900 formed from a single roll of ASTM standard A-653 steel sheet metal having a thickness ranging from about 24 gauge to 16 gauge. It shall be understood that the panel 900 may be formed of numerous gauges and other materials, such as aluminum or plastic as long as the material has the desired engineering requirements and provides the necessary structural integrity. The panel 900 comprises a central portion 902, from the ends of which extend a pair of outwardly diverging inclined side wall portions 904, 906. The panel 900 also comprises two wing portions 908, 910, which extend from the outer ends of the inclined side wall portions 904, 906, respectively. It may also be preferable to include notches 912, 914 within the wing portions 908, 910 to increase the stiffness of those portions. Similarly, although they are not illustrated in FIG. 9, it may be preferable to include a notch stiffener within each of the inclined side wall portions.

Figure 1:
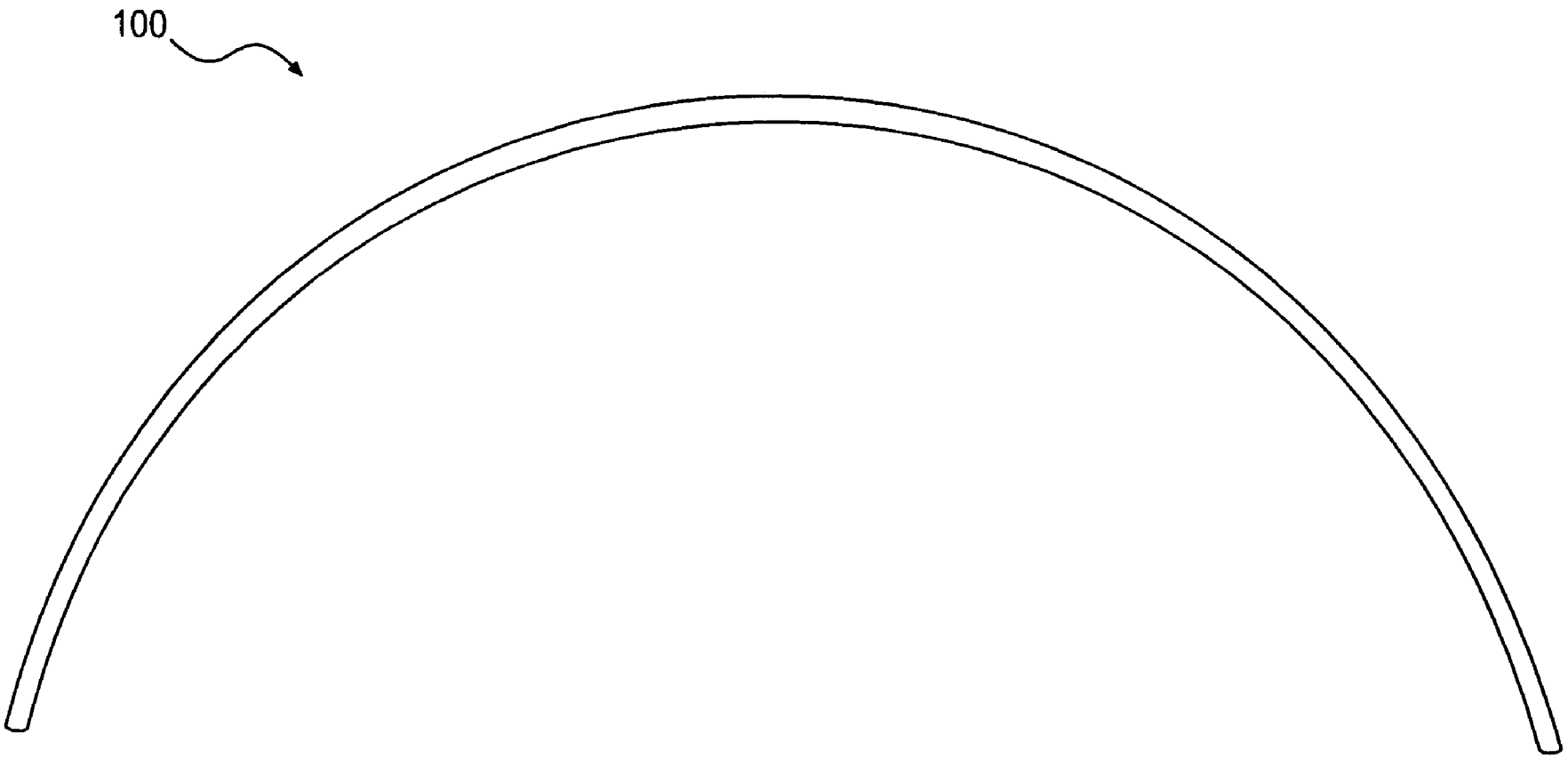
FIG. 1 PRIOR ART
FIG. 1 is a cross sectional end view of an arch style building constructed of a plurality of building panels.
Figure 2:
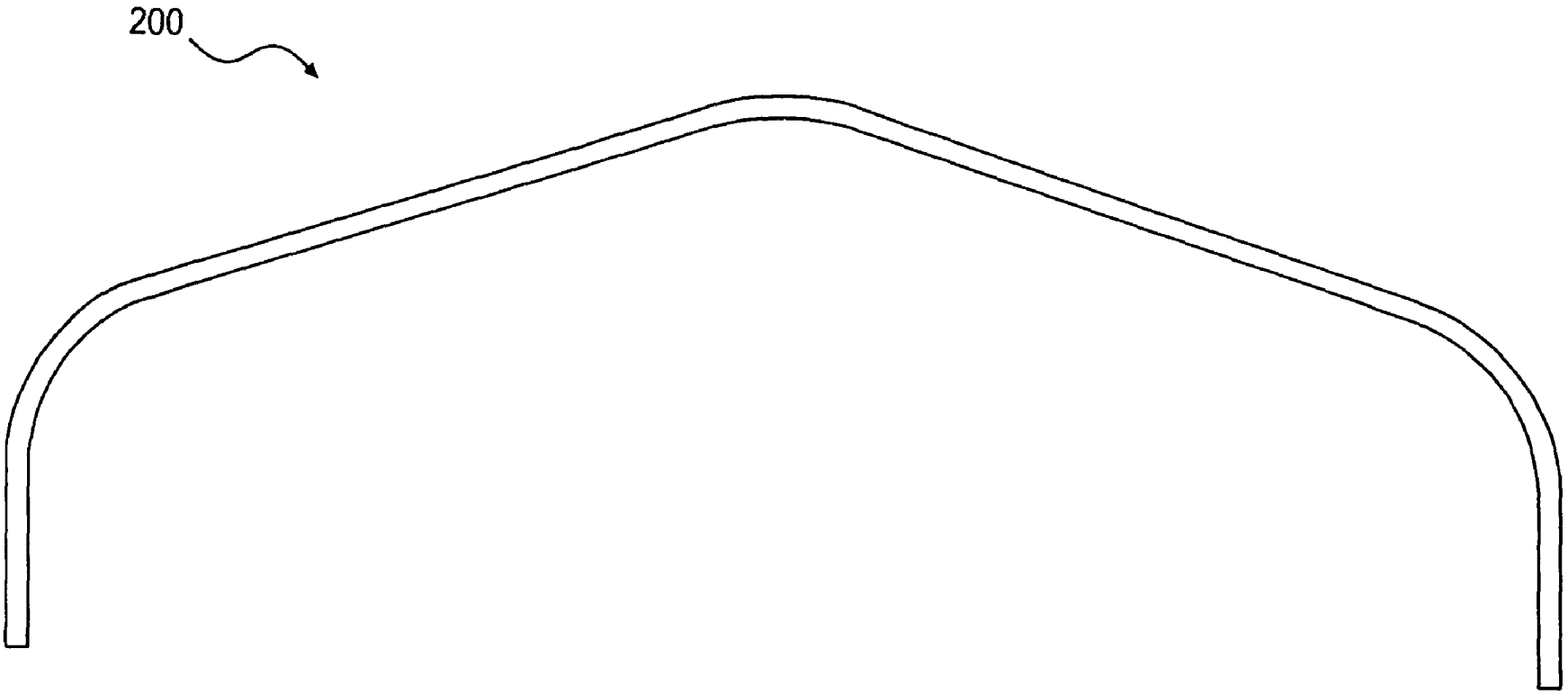
FIG. 2 PRIOR ART
FIG. 2 is a cross sectional end view of a gable style building constructed of a plurality of building panels.
Figure 3:
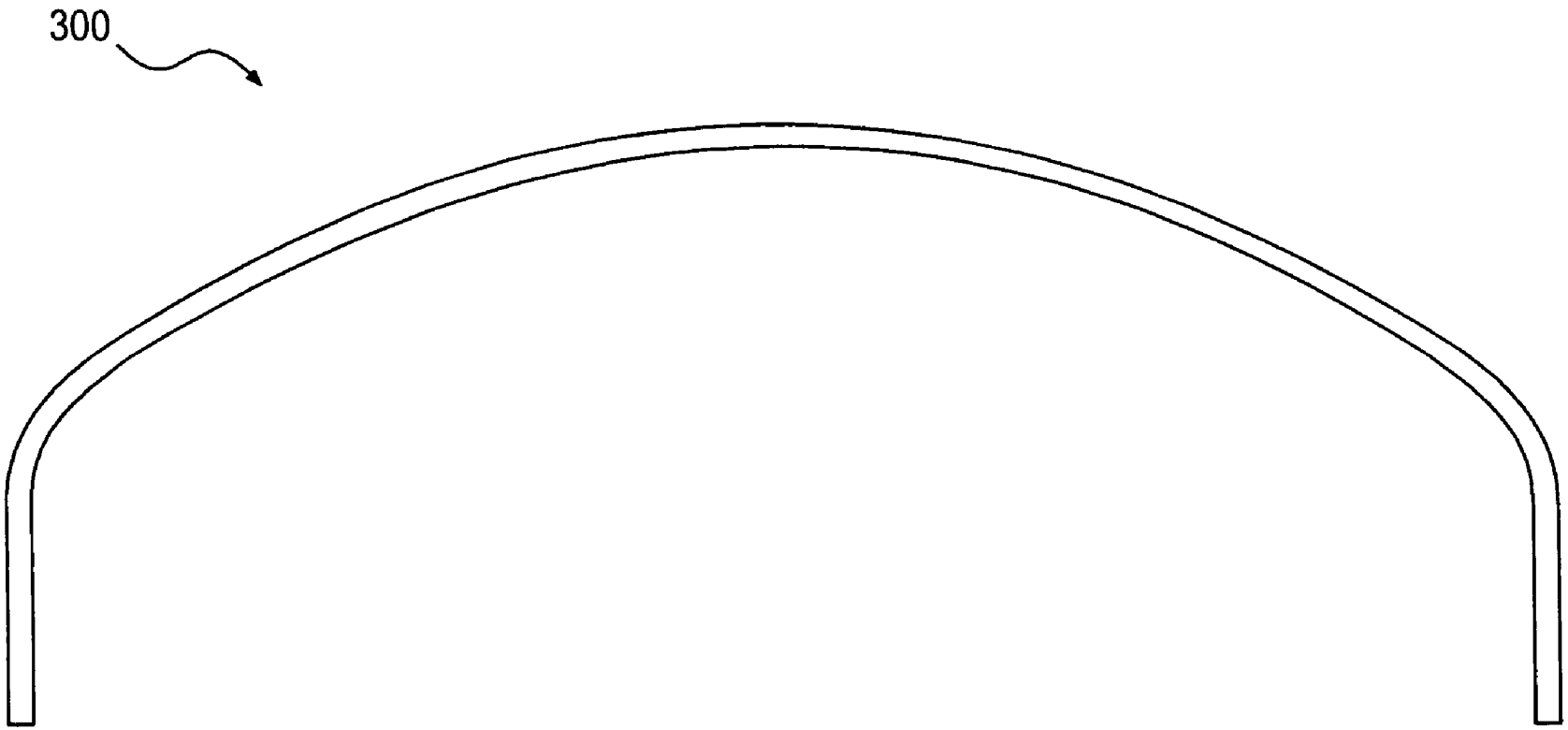
FIG. 3 PRIOR ART
FIG. 3 is a cross sectional end view of a double radius style building constructed of a plurality of building panels.
Figure 4:
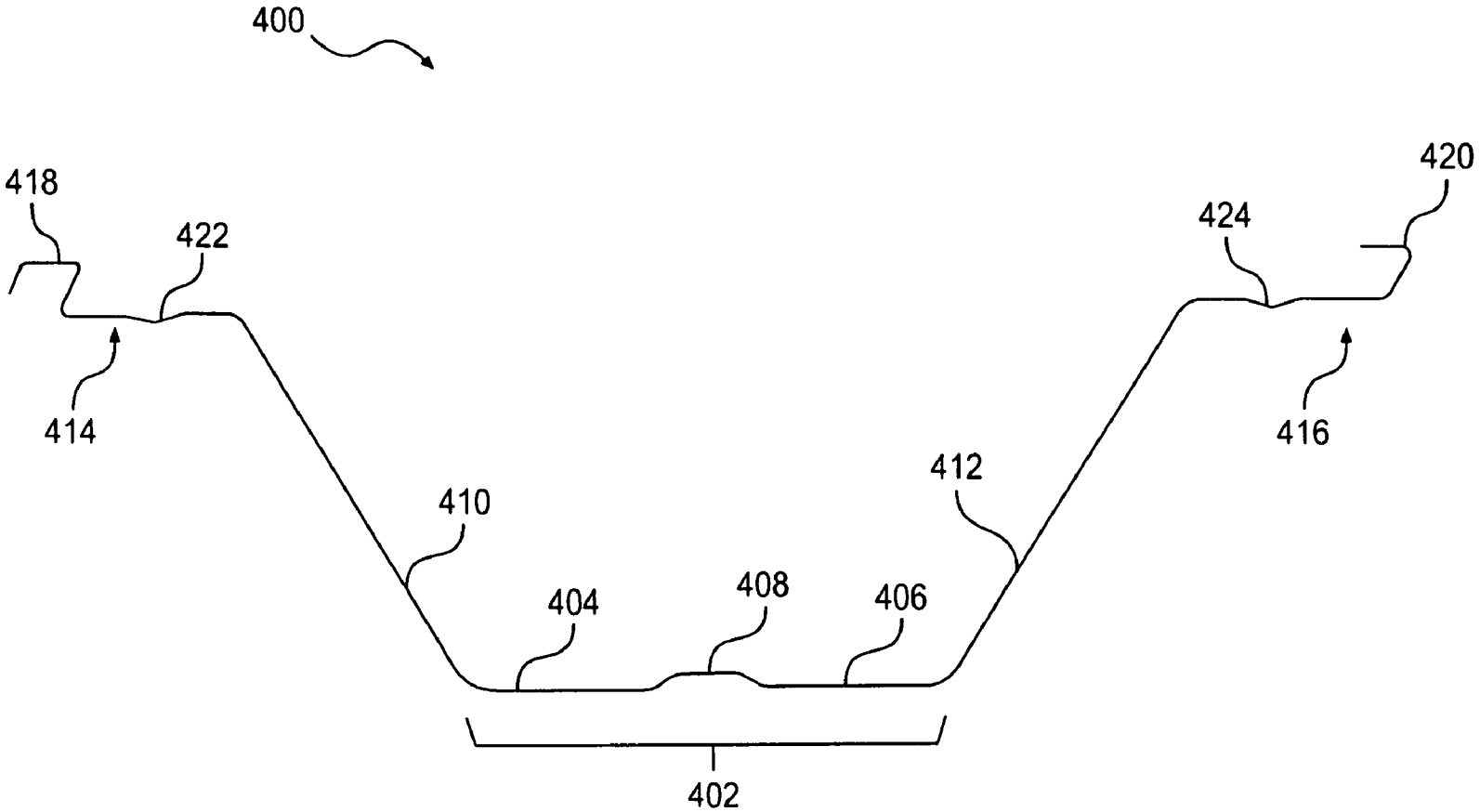
FIG. 4 PRIOR ART
FIG. 4 is a cross sectional view of one example of a known building panel.
Figure 5:
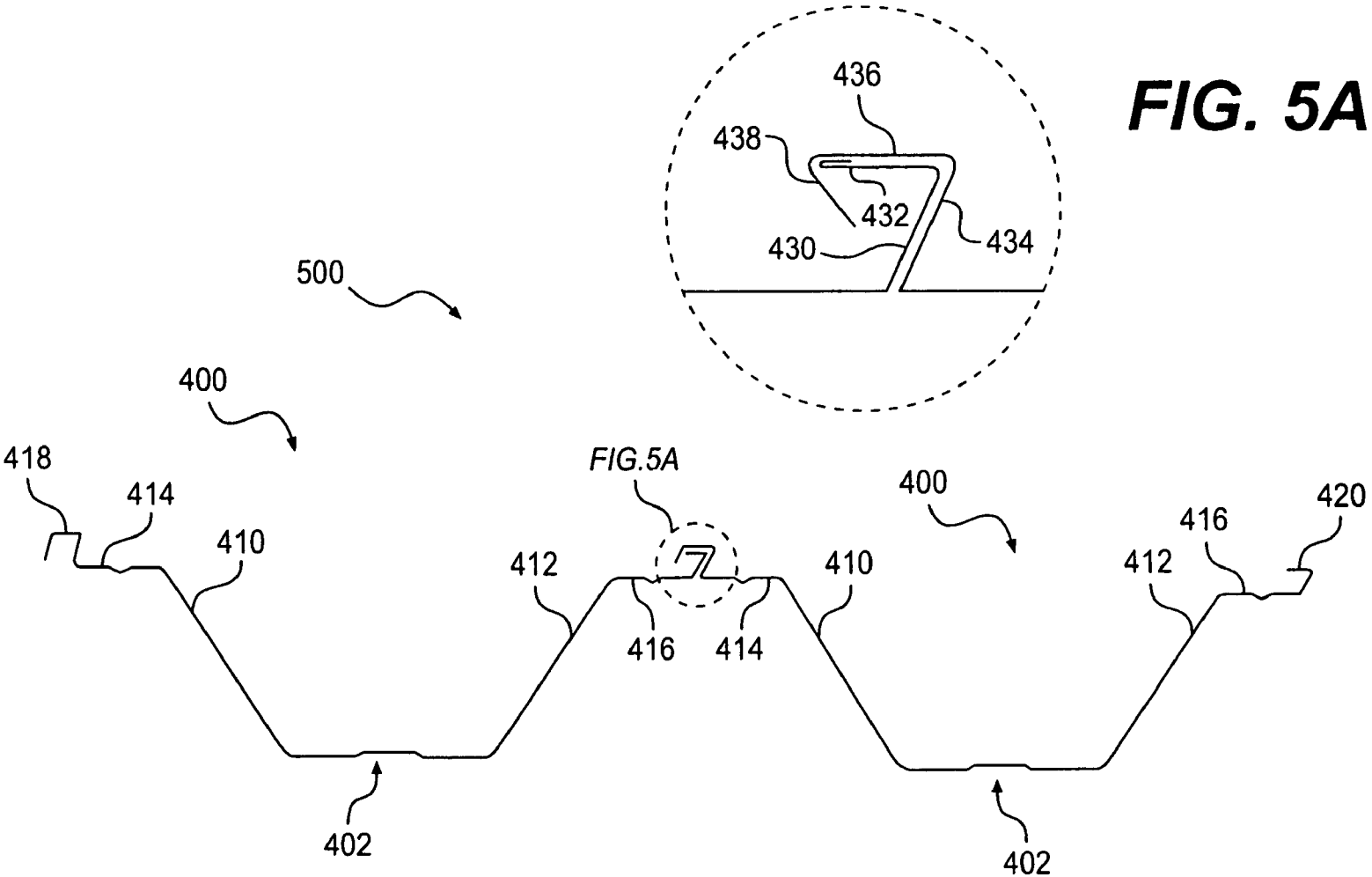
FIG. 5 PRIOR ART
FIG. 5 is a cross sectional view of an example of a building structure comprised of a plurality of building panels illustrated in FIG. 4.
Figure 6:
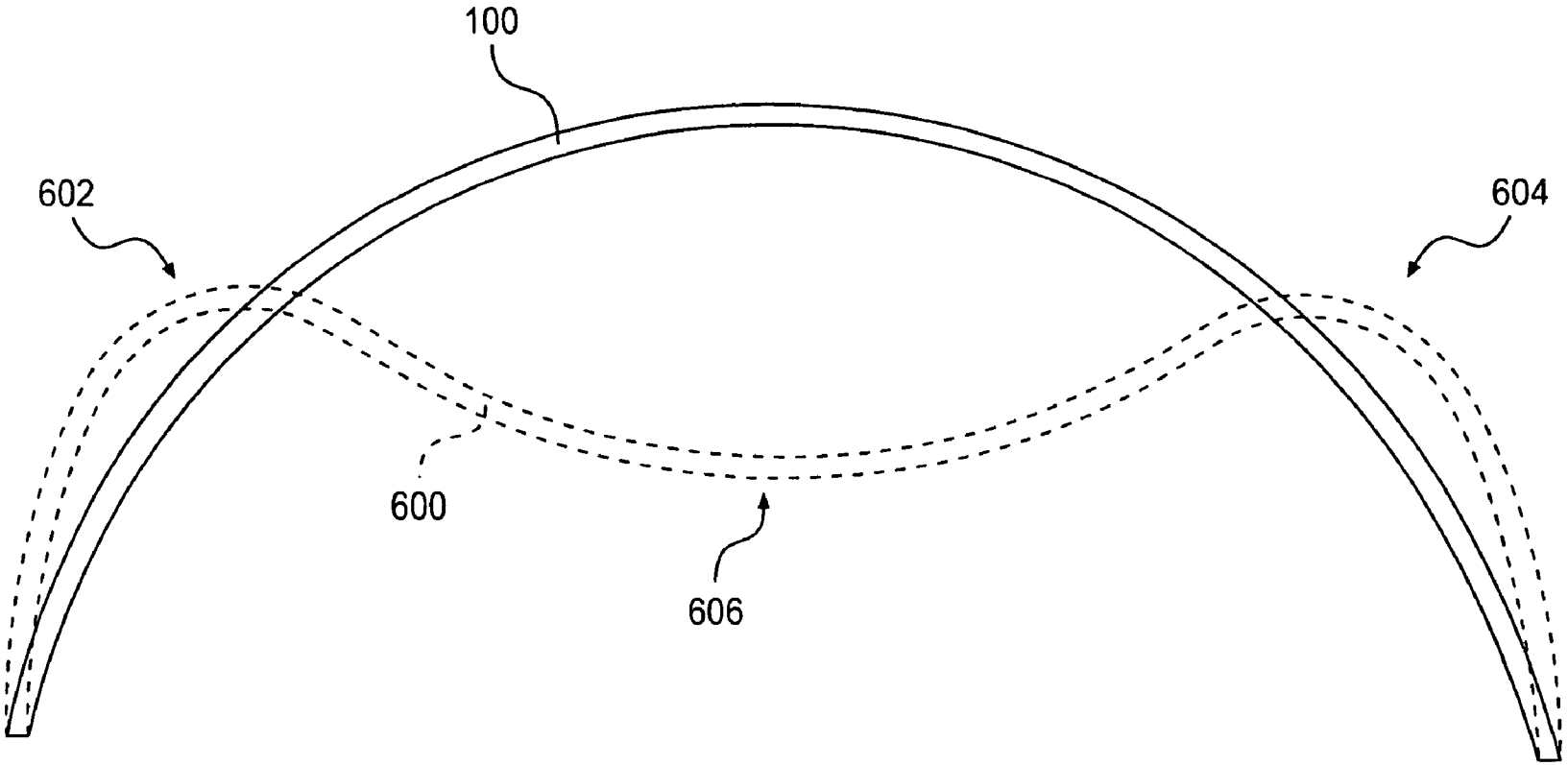
FIG. 6 PRIOR ART
FIG. 6 is an exaggerated cross sectional end view of the arch style building illustrated in FIG. 1 subject to positive and negative bending moments in comparison to the building 100 of FIG. 1 when it is not subject to such bending moments.
Figure 7:
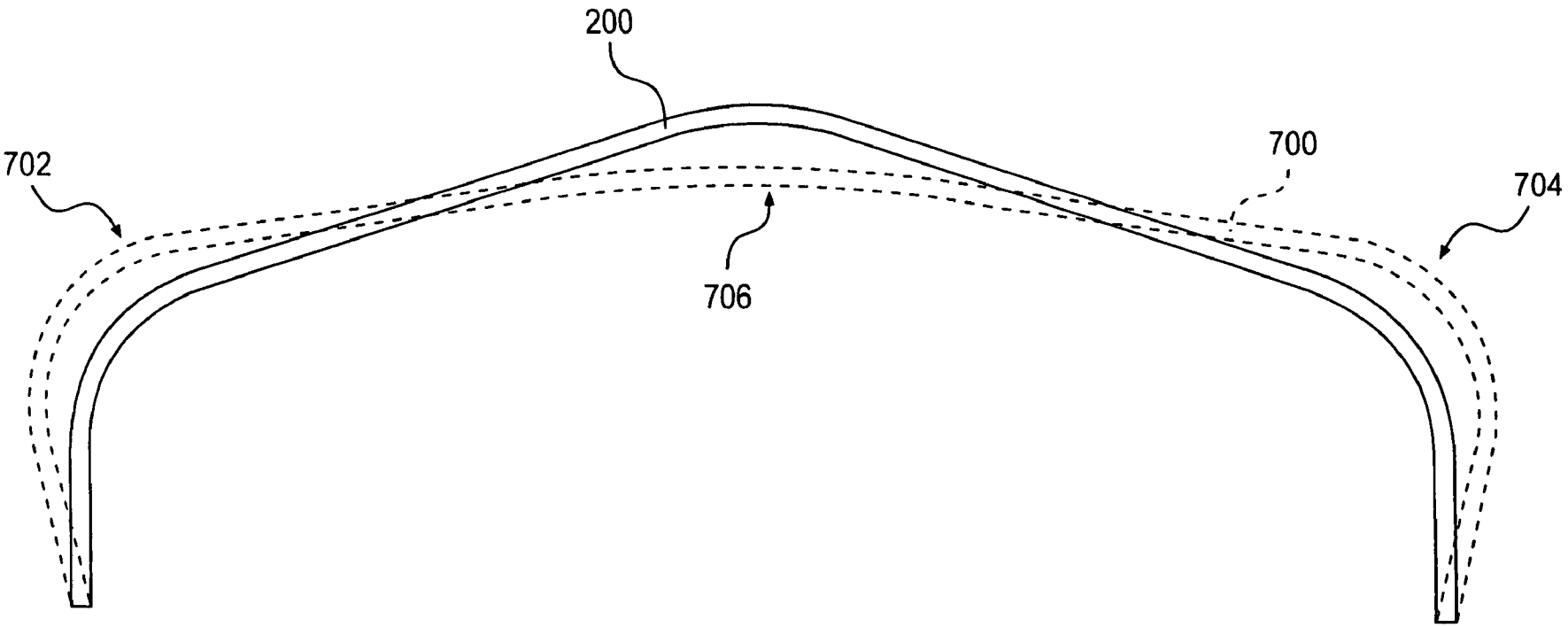
FIG. 7 PRIOR ART
FIG. 7 is an exaggerated cross sectional end view of the gable style building illustrated in FIG. 2 subject to positive and negative bending moments in comparison to the building 200 of FIG. 2 when it is not subject to such bending moments.
Figure 8:
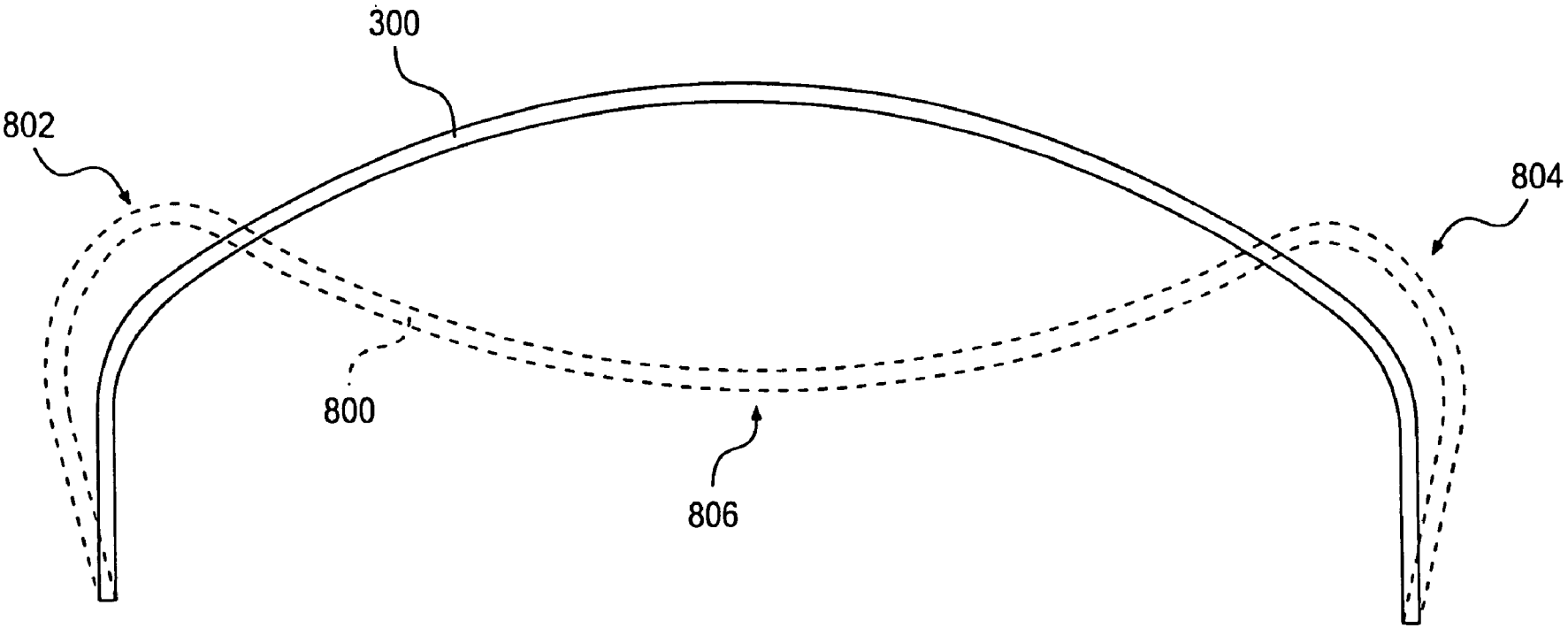
FIG. 8 PRIOR ART
FIG. 8 is an exaggerated cross sectional end view of the double radius style building illustrated in FIG. 3 subject to positive and negative bending moments in comparison to the building 300 of FIG. 3 when it is not subject to such bending moments.

Unlike the panel 400 illustrated in FIG. 4, which has a straight central portion 402, the panel of the present invention, as illustrated in FIG. 9, includes a curved central portion 902. In comparison to the straight profile of the central portion of the prior art, the curved central portion of the present invention provides the panel with greater stiffness. The increased stiffness, therefore, allows the panel to better absorb negative bending moments. Because the panel can withstand greater forces, such as weight, the design of the present invention will allow contractors to construct buildings using increased panel sizes, thereby removing some of the present design constraints.

Viewed from a perspective between the inclined side wall portions 904, 906, the curved central portion 902 has a concave shape. In other words, the central portion 902 has a curved shape similar to that of an arc, wherein an arc is a portion of a circle's entire circumference. The arc begins and ends at the points where the central portion 902 meets the inclined side wall portions 904, 906. The vertex of the arc (i.e., center of the circle) is located above the concave side of the arc and between the inclined side wall portions. Thus, the inclined side wall portions 904, 906 extend tangentially from the central portion 902.

In order to provide the panel with its maximum stiffness, it is preferable for the curved central portion 902 to have an arc with a radius ranging from 4 inches to 25 inches. It is further preferable for the curved central portion 902 to have a radius ranging from 4 inches to 12 inches, and it is even more preferable for the imaginary radius to range from 5 inches to 8 inches. Moreover, within the most preferred range, 6 inches is optimum radius for the arc.

These particular radial lengths can be correlated with angular ranges for the arc, wherein the angular range is measured between the imaginary vertices of the arc. For example, an arc with a radius ranging from 4 inches to 25 inches is preferably used with an arc ranging from 130° to 15°, respectively. Additionally, when the radius of the arc is 4 inches to 12 inches, it is preferable for the corresponding angular range to be 130° to 40°. The analogous angular ranges for a 5 inches to 8 inches arc is 120° to 60°. Furthermore, the 6 inches radius translates to an 85° arc.

Figures 10, 10A:
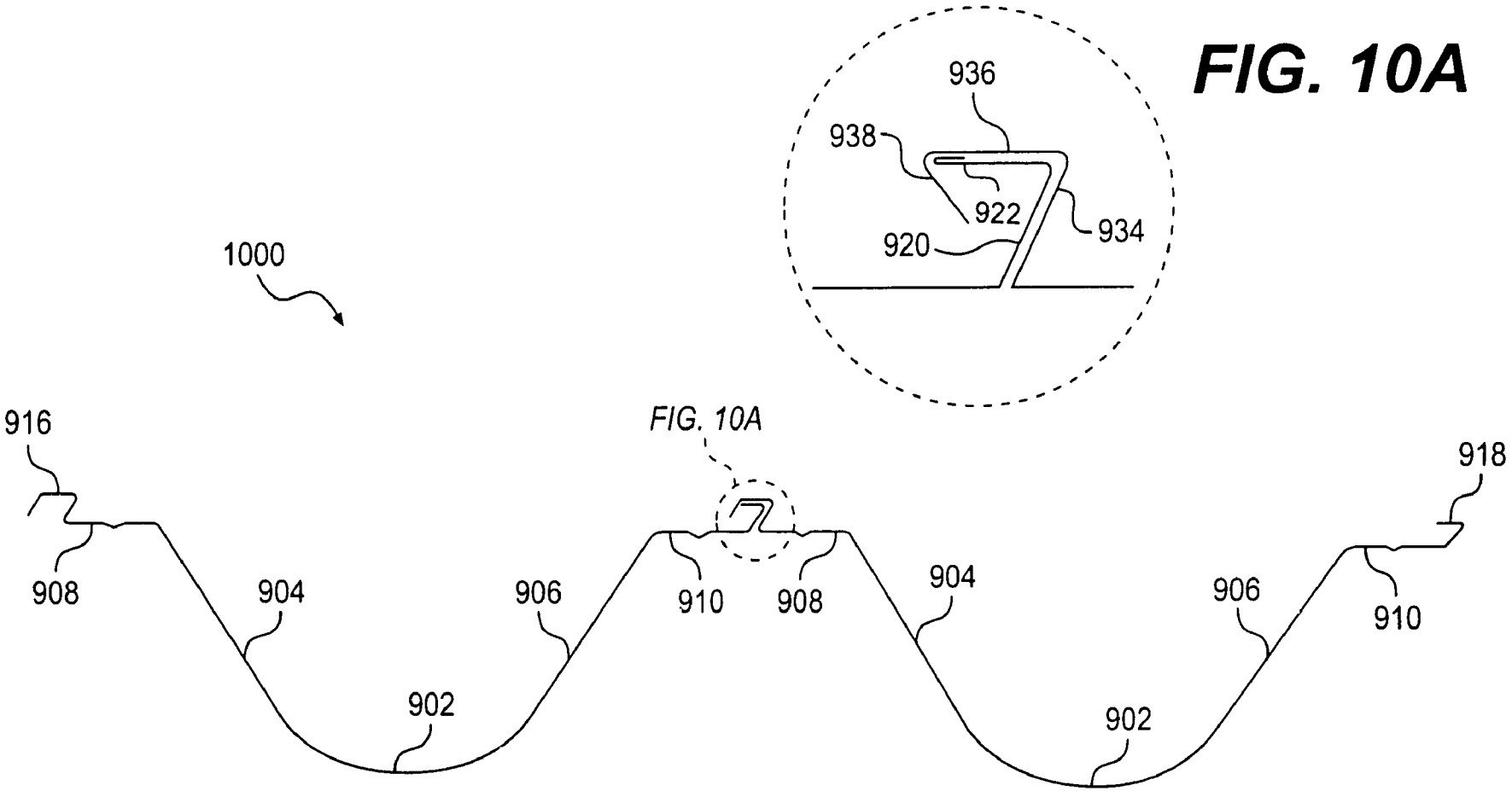
FIG. 10 is a cross sectional view of an example of a building structure comprised of a plurality of building panels illustrated in FIG. 9.
FIG. 10A is an enlarged view of the connection of the building panels illustrated in FIG. 10.

Continuing to refer to FIG. 9, at the end of one wing portion 910 is a hem portion 918, and at the end of the other wing portion 908 is a complementary hook portion 916 capable of receiving the hem portion 918. Referring to FIG. 10, and particularly FIG. 10A, the hook portion 916 comprises an inclined section 934, an intermediate section 936 and a downward edge section 938. Similarly, the hem portion 918 comprises an inclined section 920 and an end section 922.

The inclined section 934 of the hook portion 916 is parallel to the inclined section 920 of the hem portion 918. The intermediate section 936 of the hook portion 916 is parallel to the end section 922 of the hem portion 918, and both the intermediate section 936 and the end section 922 are parallel to the wing portions 908, 910. Thus, when two panels 900 are adjacent one another, the hook portion 916 from one panel and the hem portion 918 of another panel matingly engage and form a connection therebetween. Accordingly, a building structure 1000 is formed and additional panels 900 can be added to the structure by connecting further panels thereto.

As mentioned above, these panels are typically manufactured at a construction site. Thus, as discussed in U.S. Pat. Nos. 5,249,445 and 5,359,871, which are both hereby incorporated by reference, a machine capable of producing the panel of the present invention is preferably mounted on a movable trailer. This provides a contractor the ability to locate the machine directly at the particular construction site where a building utilizing such panels can be erected.

The machine includes multiple components, such as a panel forming apparatus, a shear and a crimping machine, which are all placed at different locations on the trailer. It is typical for the panel forming apparatus and the shear to be placed on one side of the trailer, while the panel crimping machine is located on the other side. The components of the panel forming apparatus include a roll holder for holding a roll of sheet metal of appropriate gauge from which the building panels are formed. The panel forming apparatus also comprises a roll forming machine, which includes a plurality of metal forming rolls for forming the sheet metal into the desired configuration described above in reference to FIG. 9.

After the newly shaped metal panel exits the roll forming machine, the panel enters a hydraulically operated shear that is located at the end of the roll forming station. Upon measuring the desired length of the metal, the shear cuts the panel into appropriately sized panels. In order to provide pressurized fluid to the shear, the trailer also usually has a hydraulic pump mounted on its bed. The hydraulic pump not only supplies the shear with fluid, but it also serves as the power source for other motors within the machine. In order to be completely mobile, the hydraulic pump is preferably powered by an internal combustion engine, and preferably a diesel engine, that is mounted on the trailer.

After the panels are formed into the desired profile and sheared to an appropriate length, the panels enter a panel crimping machine, which is typically located on the trailer on the side opposite the panel forming apparatus. The panel crimping machine corrugates the panel to further increase its strength and rigidity. The panel crimping machine includes multiple sets of crimping rollers. One set of crimping rollers crimps the central portion, and other sets of crimping rollers crimp the side wall portions. The crimping rollers used to corrugate the central portion of the panel are often referred to as the main crimping rollers. Thus, as a panel enters the crimping machine, the curved central portion passes between the main set of crimping rollers.

Figure 11:
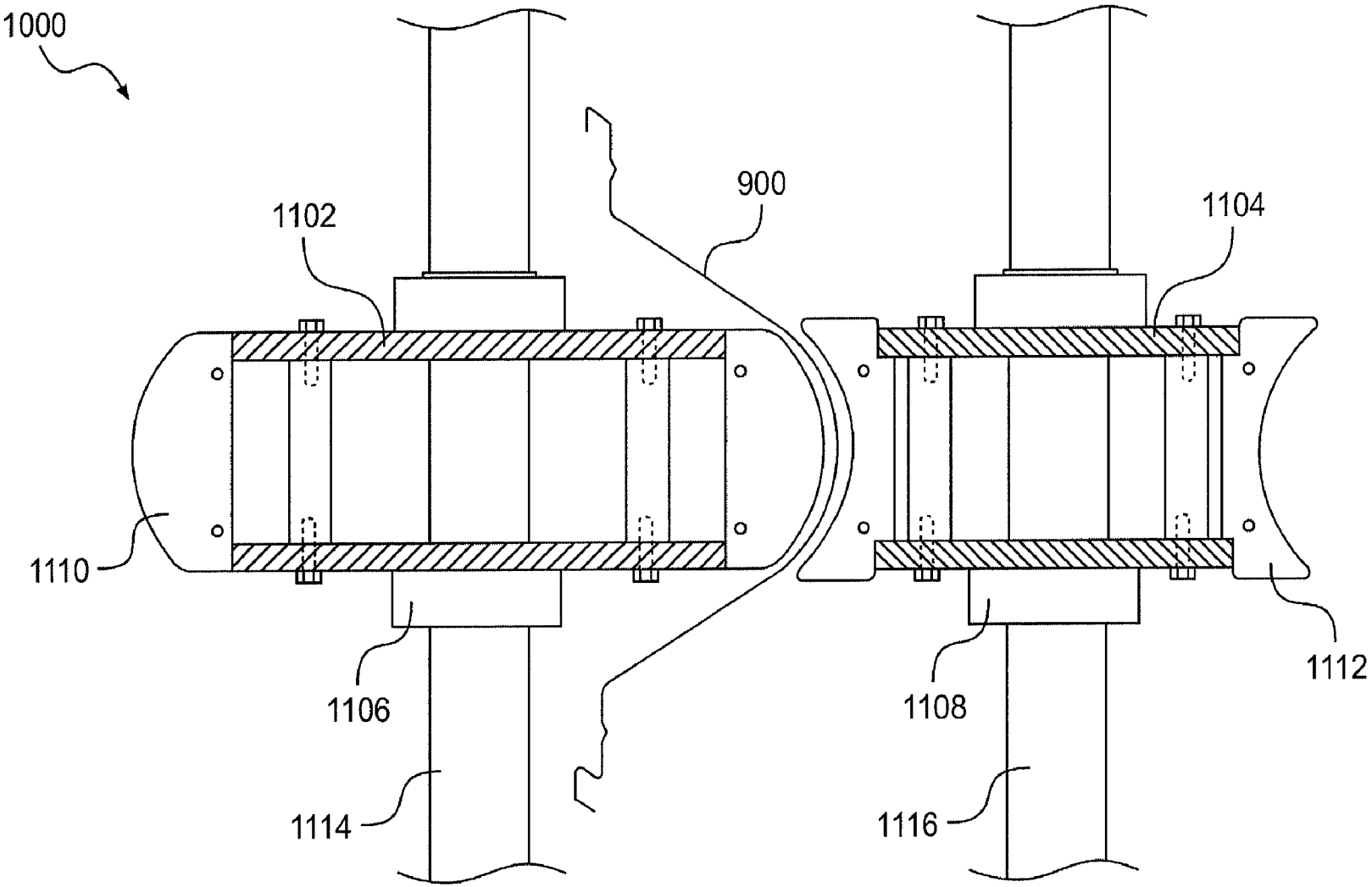
FIG. 11 is a plan view of an embodiment of a pair of crimping rollers for crimping the central portion of the building panel of the present invention as illustrated in FIG. 9.
Figure 12:
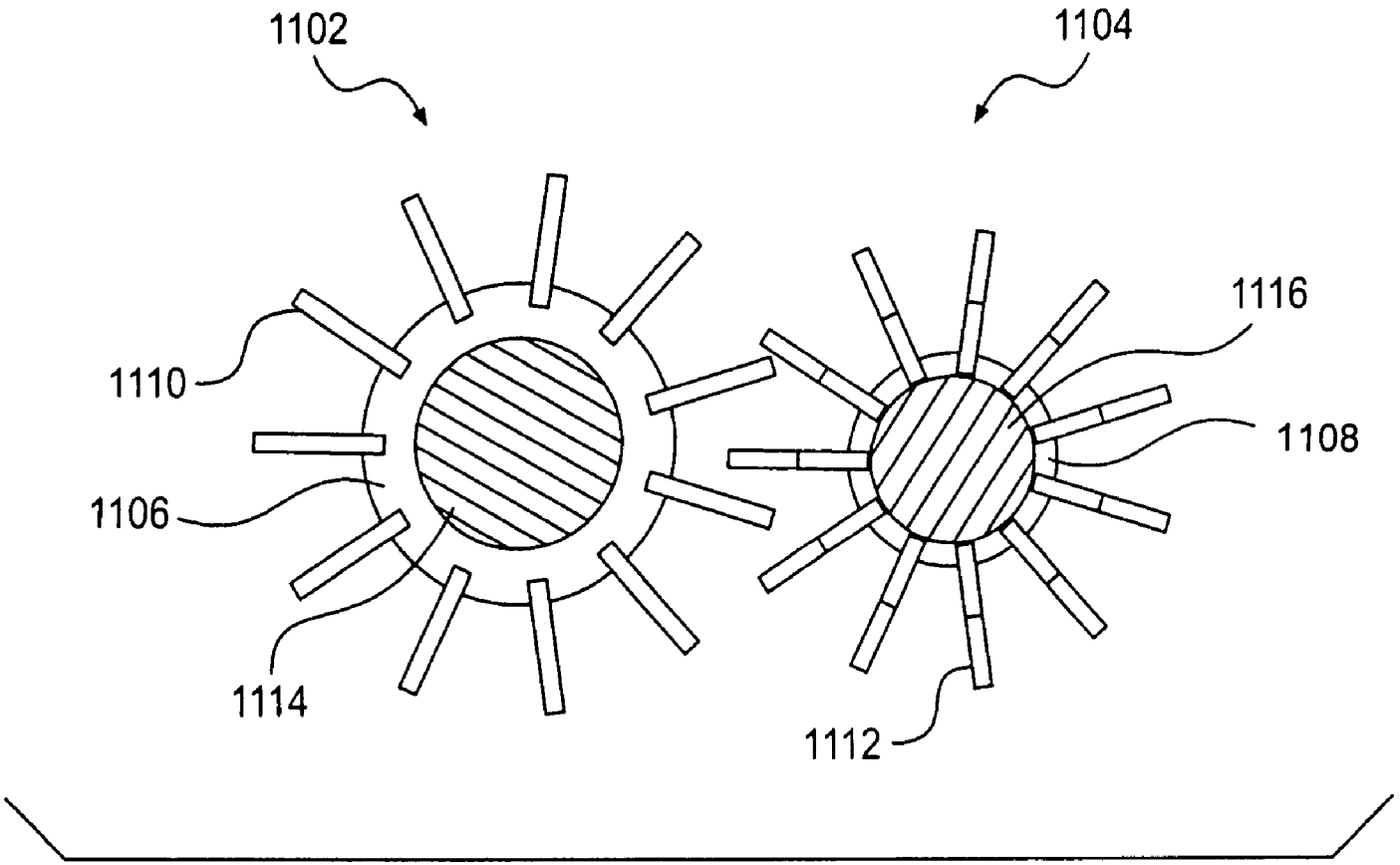
FIG. 12 is a cross sectional view of the crimping rollers illustrated in FIG. 11.

Referring to FIGS. 11 and 12, the main set of crimping rollers includes a pair of male and female crimping rollers 1102, 1104 that corrugate the central portion of the building panel 900. The crimping rollers 1102, 1104 are designed to accommodate for the profile of the curved central portion of the panel 900, thereby allowing it to pass therebetween. Specifically, both the male and female crimping rollers 1102, 1104 include a plurality of crimping blades 1110, 1112 extending radially from their respective hubs 1106, 1108. The profiles of the male crimping blades 1110 and the female crimping blades 1112 are complementary because the male crimping blades 1110 have a convex profile and the female crimping blades 1112 have a concave profile. Thus, as the panel 900 goes through the crimping machine, and particularly between the crimping rollers 1102, 1104, the crimping blades 1110, 1112 intersect one another and corrugate the central portion of the panel. Specifically, the convex profiled male crimping blades 1110 contact the concave side of the central portion 902 of the panel 900, and the concave profiled female crimping blades 1112 contact the convex side of the panel.

As the panel 900 passes between the crimping rollers 1102, 1104, the crimping rollers may also create the curved profile to the central portion. In other words, as the panel leaves the panel forming machine, described above, the central portion of the panel may have a straight profile. In that case, the straight central portion would be fed into the crimping rollers, and the crimping machine would simultaneously impart the curved profile to the central portion and crimp that portion. Thus, as the panel exits the crimping machine, it would have a curved central portion with corrugations formed therein.

Each crimping roller 1102, 1104 is attached to a respective shaft 1114, 1116, and the shafts are connected to a means for driving the crimping rollers. As discussed in U.S. Pat. Nos. 4,364,253, 4,505,143 and 4,505,084, all of which are hereby incorporated by reference, there are numerous types of drive systems available for driving the crimping rollers. The drive system can be configured such that one of the crimping rollers is driven while the other idles, but it is preferable that both crimping rollers be driven.

The crimping rollers are typically driven by a motor, and because the panel forming machine and/or shear are powered by a common hydraulic system, it is preferable that the crimping machine motor also by a hydraulic motor. As mentioned above, the crimping rollers 1102, 1104 are connected to shafts 1114, 1116. Thus, the mechanical drive system links the shafts to the motor. The mechanical drive system can include a combination of shafts, gears, sprockets, pulleys, chains, belts, etc. For example, one drive system may include mounting a gear on the shaft 1114 extending through the male crimping roller 1102 and mounting another gear on the shaft 1116 extending through the female crimping roller 1104 such that both gear engage one another. That drive system shall also include an idler sprocket that engages one of the gears connected to the shafts, wherein the shaft of the motor connected is connected to and driving said idler gear, which in turn rotates the gears, thereby turning the male and female crimping rollers.

It may also be preferable to include a clutch, and particularly a reversing clutch, between the motor and the idler worm gear for maintaining a constant speed between the male and female crimping rollers. Additionally, it may also be preferable to adjust the gap between the two crimping roller 1102, 1104. If so, it would be desirable to include a gap adjusting mechanism to the crimping machine.

Although the invention has been described and illustrated with respect to the exemplary embodiments thereof, it should be understood by those skilled in the art that the foregoing and various other changes, omissions and additions may be made without departing from the spirit and scope of the invention. For example, in lieu of driving the crimping rollers in the manner described above, it may also be desirable to directly couple the motor shaft to one of the gears. Thus, other known drive systems capable of driving the complementary concave and convex crimping rollers shall be considered within the scope of this invention.

What is claimed is:

1. A building panel configured to be a load-bearing panel of a self-supporting building structure, the building panel comprising:

(a) a curved central portion having a curved shape in cross section perpendicular to a longitudinal direction along a length of the building panel, the curved central portion having transverse corrugations therein;

(b) a pair of side wall portions extending from opposite ends of said curved central portion in cross section, said curved central portion being concave-shaped in cross section from a perspective between said side wall portions, wherein said sidewall portions comprise straight portions that extend tangentially in cross section from the concave-shaped curved central portion;

(c) a pair of complementary wing portions extending from said side wall portions, (d) wherein said building panel is curved in the longitudinal direction; and (e) wherein said building panel is formed from sheet material and configured to mate with adjacent building panels so as to form a load-bearing panel of a self-supporting building structure.

2. The building panel of claim 1, wherein said curved central portion comprises an arc.

3. The building panel of claim 2, wherein said arc ranges from 15° to 130°.

4. The building panel of claim 2, wherein said arc ranges from 40° to 130°.

5. The building panel of claim 4, wherein said arc ranges from 60° to 120°.

6. The building panel of claim 5, wherein said arc is 85°.

7. The building panel of claim 2, wherein said arc has a radius ranging from 4 inches to 25 inches.

8. The building panel of claim 2, wherein said arc has a radius ranging from 4 inches to 12 inches.

9. The building panel of claim 8, wherein said radius ranges from 5 inches to 8 inches.

10. The building panel of claim 8, wherein said radius is 6 inches.

11. The building panel of claim 1, wherein said side wall portions extend at an incline from said opposite ends of said curved central portion.

12. The building panel of claim 1, wherein one of said wing portions comprises a hook portion and the other of said wing portions comprises a hem portion.

13. A self-supporting building structure, comprising a plurality of interconnected panels configured to be a load-bearing wall of the self-supporting building structure, one or more of said panels comprising:

(a) a curved central portion having a curved shape in cross section perpendicular to a longitudinal direction along a length of the building panel, the curved central portion having transverse corrugations therein;

(b) a pair of side wall portions extending from opposite ends of said curved central portion in cross section, said curved central portion being concave-shaped in cross section from a perspective between said side wall portions, wherein said side wall portions comprise straight portions that extend tangentially in cross section from the concave-shaped curved central portion;

(c) a pair of wing portions extending from said side wall portions, wherein one wing portion extends from a first of said side wall portions and the other wing portion extends from a second of said side wall portions, wherein said one wing portion from a first of said panels is connected to said other wing portion from a second of said panels, (d) wherein each of the one or more panels is curved in the longitudinal direction; and (e) wherein each of the one or more panels are formed from sheet material and configured to mate with adjacent building panels so as to form a load-bearing wall of a self-supporting building structure.

14. The building structure of claim 13, wherein said curved central portion comprises an arc.

15. The building structure of claim 14, wherein said arc ranges from 15° to 130°.

16. The building structure of claim 14, wherein said arc has a radius ranging from 4 inches to 25 inches.

17. The building structure of claim 13, wherein said one wing portion comprises a hook portion and said other wing portion comprises a complementary hem portion such that said hook and hem portions interconnect.

18. The building structure of claim 13, wherein said side wall portions extend at an incline from said opposite ends of said curved central portion.

19. The building structure of claim 13, wherein said central portion is without a longitudinal stiffening notch.

20. The building panel of claim 1, wherein said central portion is without a longitudinal stiffening notch.

21. The building panel of claim 1, wherein the curved central portion is curved in cross section over an entire width of the curved central portion.

22. The building structure of claim 13, wherein the curved central portion is curved in cross section over an entire width of the curved central portion.

* * * * *